US006199688B1

(12) United States Patent
Focke

(10) Patent No.: US 6,199,688 B1
(45) Date of Patent: Mar. 13, 2001

(54) HINGE-LID PACKET PLUS METHOD AND DEVICE FOR MANUFACTURING SAME

(75) Inventor: Heinz Focke, Verden (DE)

(73) Assignee: Focke & Co., (GmbH & Co.), Verden (DE)

( * ) Notice: Subject to any disclaimer, the term of this patent is extended or adjusted under 35 U.S.C. 154(b) by 0 days.

(21) Appl. No.: 09/202,124

(22) PCT Filed: Sep. 5, 1997

(86) PCT No.: PCT/EP97/04831

§ 371 Date: Jul. 16, 1999

§ 102(e) Date: Jul. 16, 1999

(87) PCT Pub. No.: WO98/09875

PCT Pub. Date: Mar. 12, 1998

(30) Foreign Application Priority Data

Sep. 6, 1996 (DE) ..... 196 36 365

(51) Int. Cl.[7] ..... B65D 85/10

(52) U.S. Cl. ..... 206/268; 206/265; 206/459.5; 493/53

(58) Field of Search ..... 206/265, 268, 206/271, 273, 459.5; 493/53, 54, 56

(56) References Cited

U.S. PATENT DOCUMENTS 4,287,797 * 9/1981 Seragnoli .
4,682,038 * 7/1987 Focke .
4,938,005 * 7/1990 Focke .
5,261,209 * 11/1993 Focke et al. .
5,311,800 * 5/1994 Focke et al. .
5,853,860 * 12/1998 Calvert ..... 428/204

FOREIGN PATENT DOCUMENTS

| | | |
|---|---|---|
| 2160297 | 6/1973 | (DE) . |
| 29 40 421 | 4/1981 | (DE) . |
| 32 30 833 | 2/1984 | (DE) . |
| 37 13 612 | 11/1988 | (DE) . |
| 39 16 756 | 11/1990 | (DE) . |
| 90 13 901 | 2/1991 | (DE) . |
| 38 25 569 | 8/1992 | (DE) . |
| 44 29 095 | 3/1995 | (DE) . |
| 43 33 462 | 4/1995 | (DE) . |
| 195 06 844 | 8/1996 | (DE) . |
| 007 410 | 2/1980 | (EP) . |
| 476 882 | 3/1992 | (EP) . |
| 646 531 | 4/1995 | (EP) . |

* cited by examiner

*Primary Examiner*—Jim Foster
(74) *Attorney, Agent, or Firm*—Sughrue, Mion, Zinn, Macpeak & Seas, PLLC

(57) ABSTRACT

On hinge-lid packets, a collar (31) is usually arranged in a packet portion (10) and is fastened with a lower partial region of collar front wall and collar side flaps (33, 34) to inner sides of packet front wall (12) and packet side walls (14, 15) by gluing. An upper region of the collar (31) protruding out of the packet portion (10) forms visible surfaces (54). These are preferably provided over their whole area with printing or a printed color layer (40) and an outer protective layer (42). Fastening surfaces (51, 52) lying in the packet portion (10) are free of printed color layers and protective layers.

11 Claims, 7 Drawing Sheets

HINGE-LID PACKET PLUS METHOD AND DEVICE FOR MANUFACTURING SAME

SPECIFICATION

Figure 1:
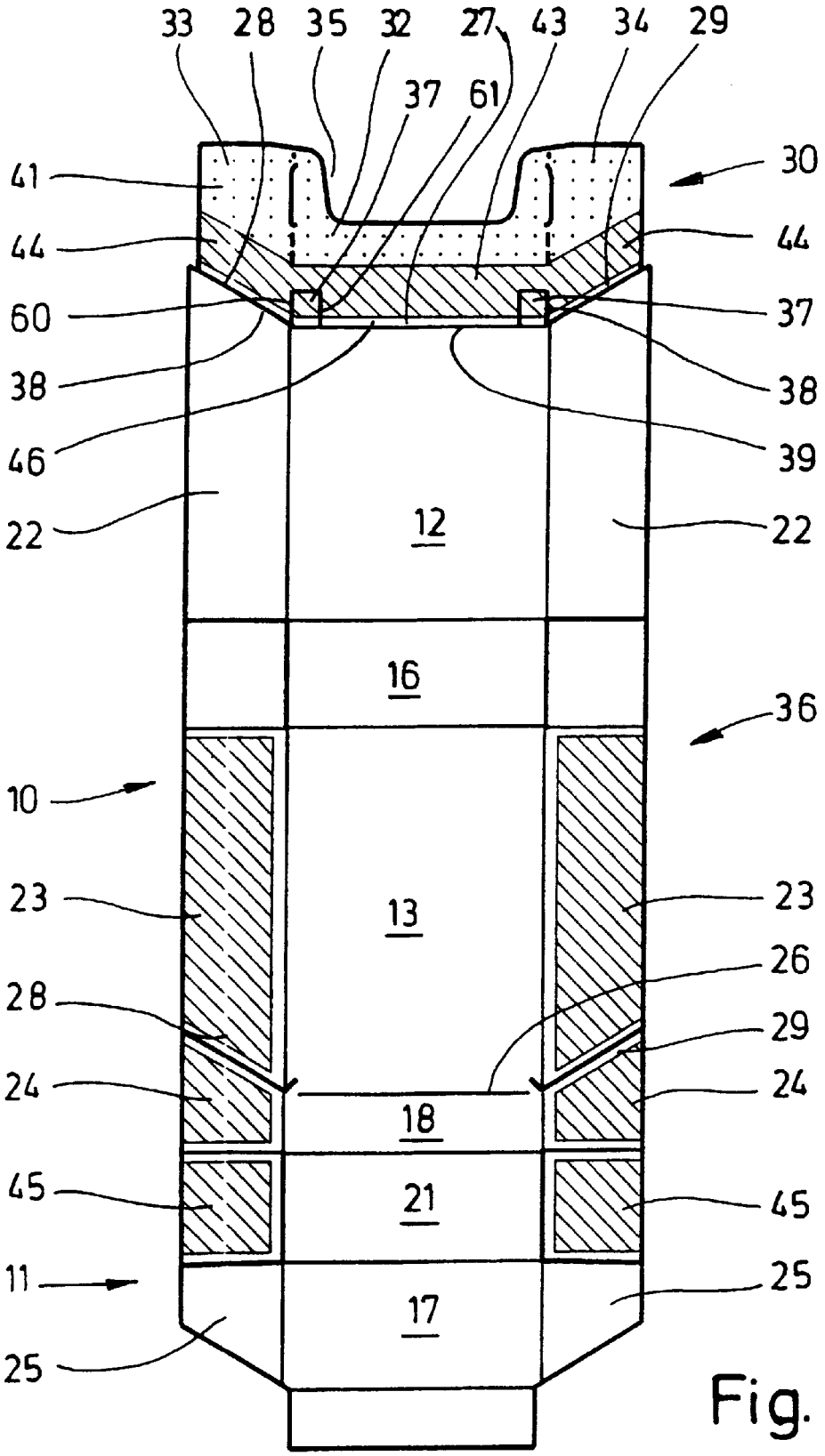

The invention relates to a hinge-lid packet made of (thin) cardboard, comprising a packet portion and a lid which is connected by a hinge in the region of a lid rear wall via a line joint to a packet rear wall, a collar being arranged in the packet portion and attached with lower fastening surfaces in the region of the collar front wall and collar side flaps to the inner side of a packet front wall or packet side walls and of which the region protruding from the packet portion forms free visible surfaces. In addition, the invention relates to a method and device for manufacturing hinge-lid packets of this type.

The standard design of hinge-lid packets is such that a collar is arranged in the packet portion, a partial region of which collar protrudes from the packet portion. This upper portion of the collar is enclosed by the lid when the packet is closed. The collar consists of a separate blank, likewise made of (thin) cardboard, but can also be connected as one piece to the (main) blank for packet portion and lid. The entire hinge-lid packet consists in this case of one single blank.

On the previously usual hinge-lid packets, the collar is always configured continuously in white or in natural colours—corresponding to the colour of the material used for the collar. The hinge-lid packet itself, on the other hand, is covered externally on all sides in the region of the packet portion and the lid with coloured printing.

The object underlying the invention is further to develop and improve hinge-lid packets in respect of their design.

In achieving this object, the hinge-lid packet according to the invention is characterised by the following features:

a) the free visible surfaces of the collar front wall and/or collar side flaps protruding from the packet portion are covered with printing, namely with a printed colour layer applied to the visible surfaces, b) the printing in the region of the collar front wall and/or collar side flaps is covered by a protective layer, especially a coat of lacquer or varnish, c) the protective layer, or coat of lacquer or varnish extends over the whole region of the visible surfaces of the collar front wall and/or the collar side flaps and ends in the region of an upper front closing edge formed by the packet front wall, or in the region of upper side closing edges formed by the packet side walls, in such a way that the fastening surfaces of the collar front wall and/or collar side flaps are free of any protective layer or coat of lacquer or varnish.

Due to the invention it is possible to print the collar in a way that is perfect in respect of packaging technology. Preferably, only the regions of the collar protruding from the packet portion are provided with printing of this kind as the remaining regions are covered. In this preferred embodiment, an outer protective layer of lacquer or varnish such as is usual with this kind of printing is likewise only provided in the region of the surfaces of the collar protruding from the packet portion. According to the further ideas of the invention, this makes possible adequate or technically perfect fastening of the collar inside the packet portion by gluing. The surfaces to be provided with glue, namely the fastening surfaces of the collar, are thus, according to the invention, free of any printing and also free of any protective layers.

The invention can also be used especially advantageously with one-piece (total) blanks for hinge-lid packets. On this type of packet, the collar is expediently connected via flaps or webs folded in a Z-shape to the packet portion, especially the packet front wall.

On traditional hinge-lid packets with a collar made from a separate blank, the different surfaces of the collar, namely the printed visible surfaces and/or those provided with a protective layer on the one hand and the fastening surfaces without any printing and/or protective layer, are expediently applied in the region of a continuous web of material for the production of blanks for collars. The cuts or perforations for separating the collar and corresponding to the shape of the collar are then—controlled by print marks—realised in the region between successive visible surfaces and fastening surfaces of adjacent collars.

A further special characteristic is a device configured according to the invention for producing individual planks for collars. Here a pre-printed material web consisting of in particular thin cardboard is led through a cutting device with at least one cutting cylinder, on the circumference of which a number of (cutting) blades is arranged corresponding to the contour of the collars. The distance of the blades from one another is slightly larger than the corresponding dimensions of a collar in order to compensate for movement differences between the material web and cutting cylinder or cutter wheel.

Figure 2:
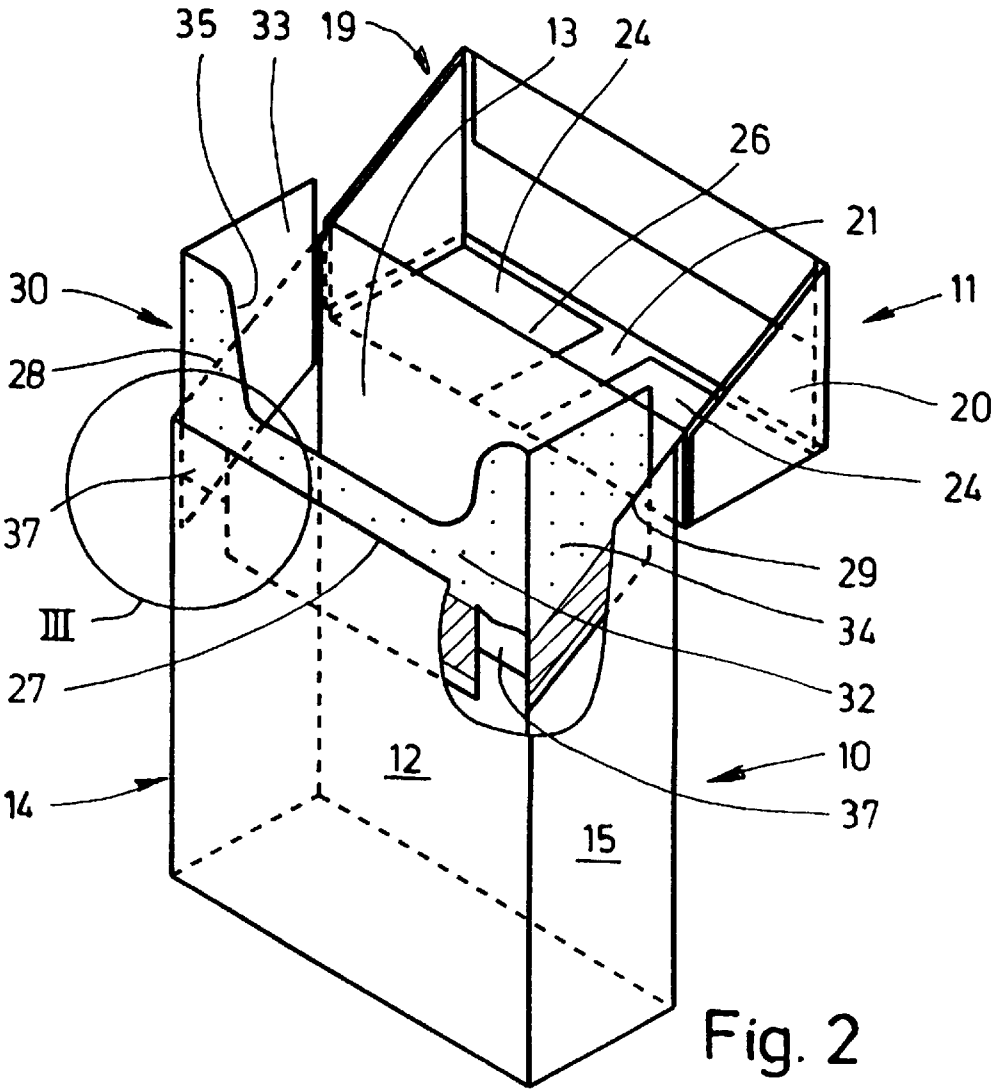
Figure 3:
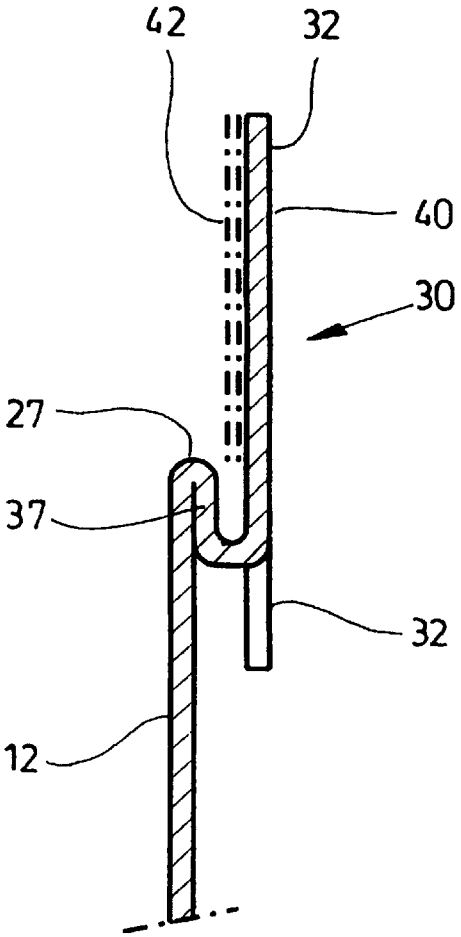
Figure 4:
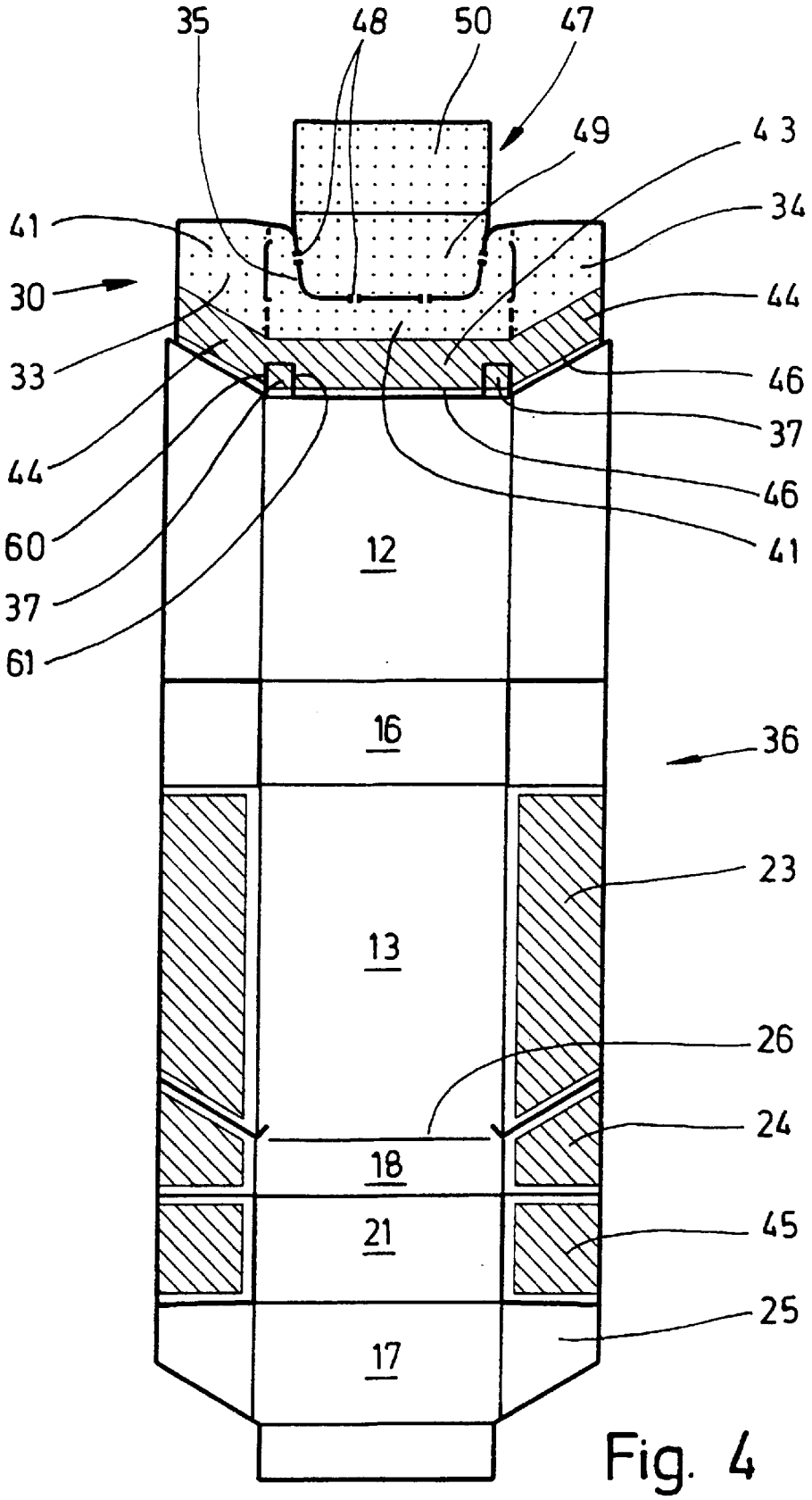
Figure 5:
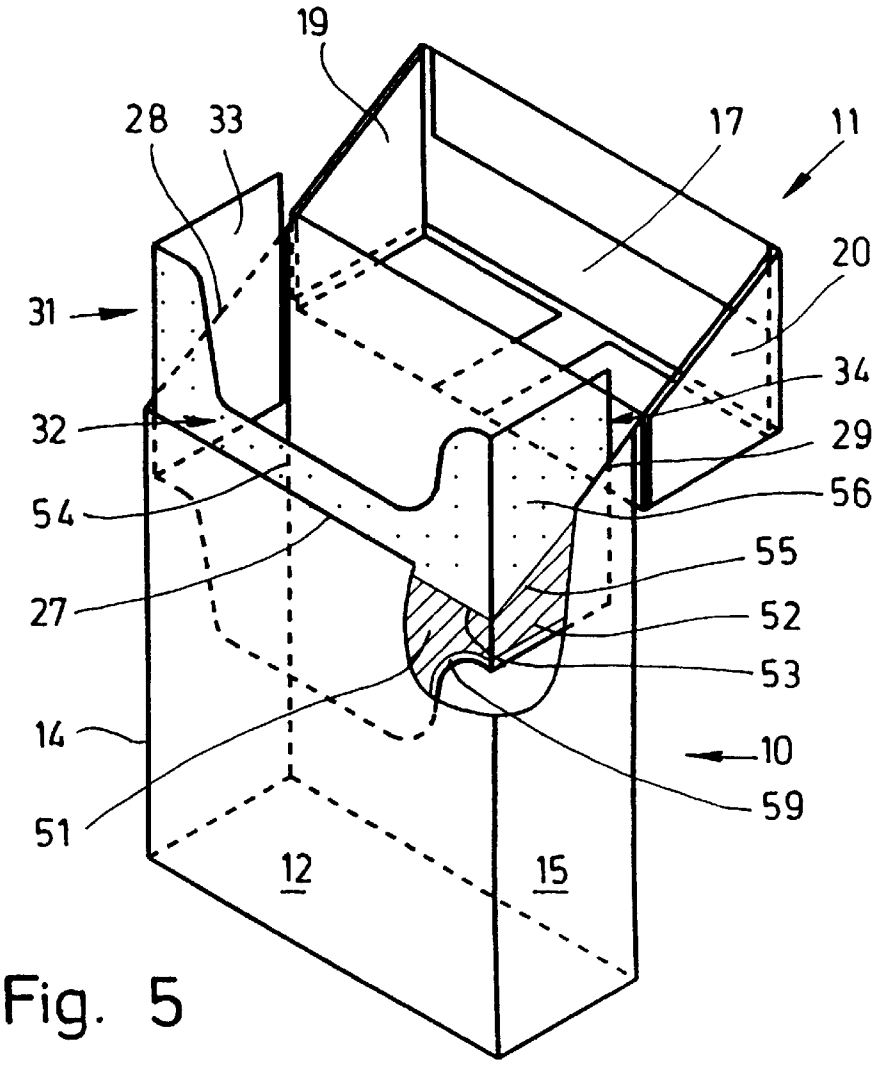
Figure 6:
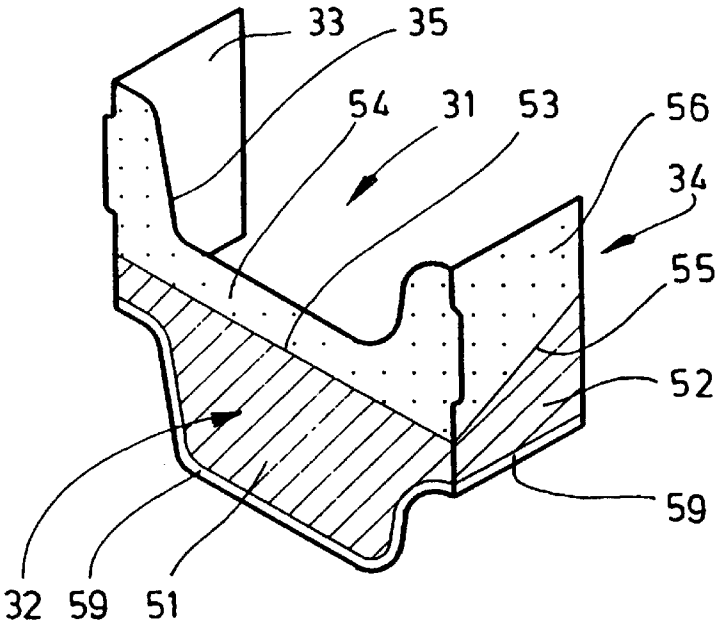
Figure 7:
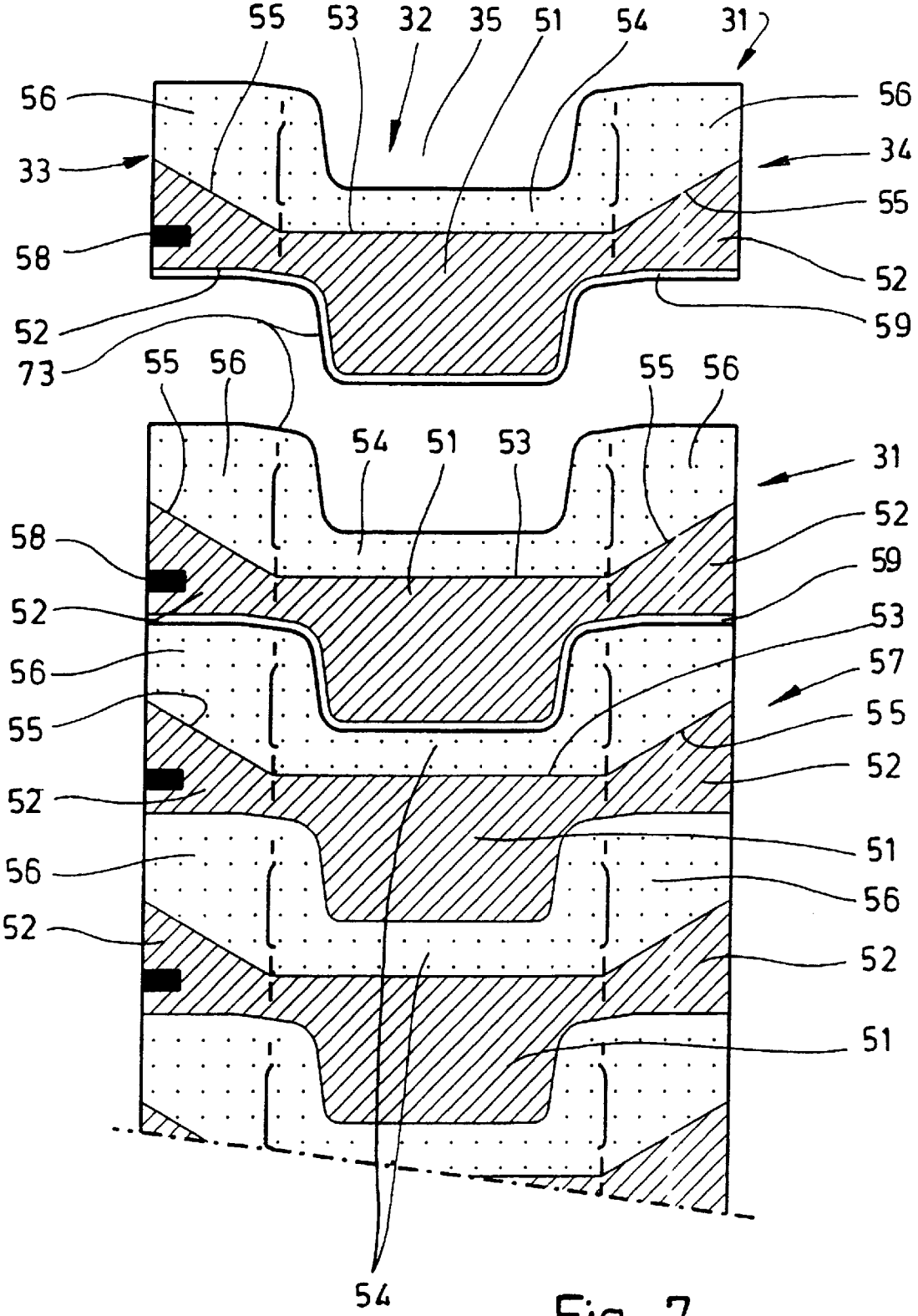
Figure 8:
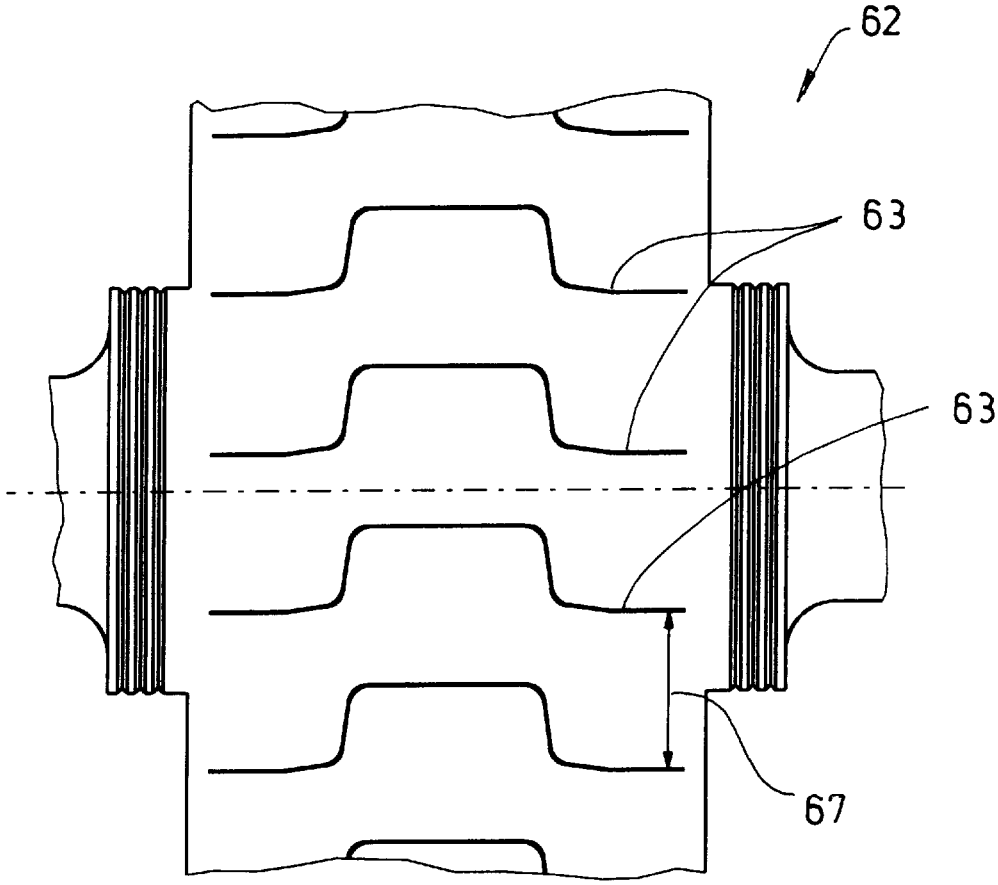
Figure 9:
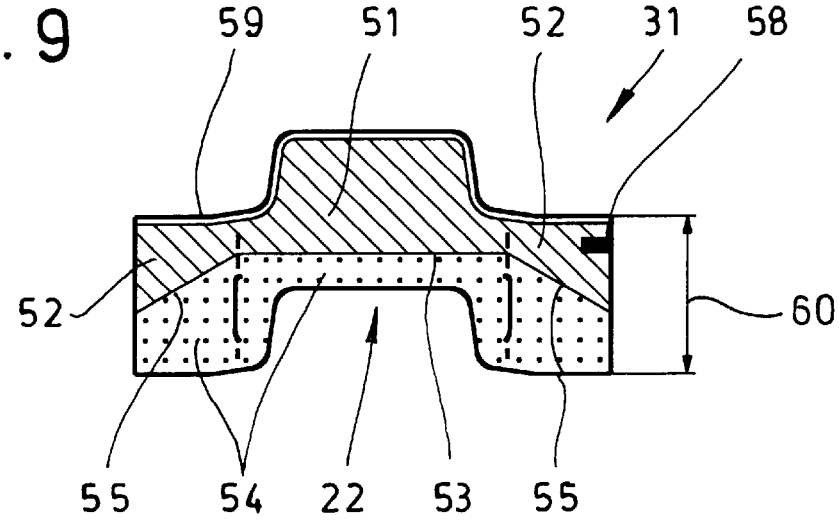
Figure 10:
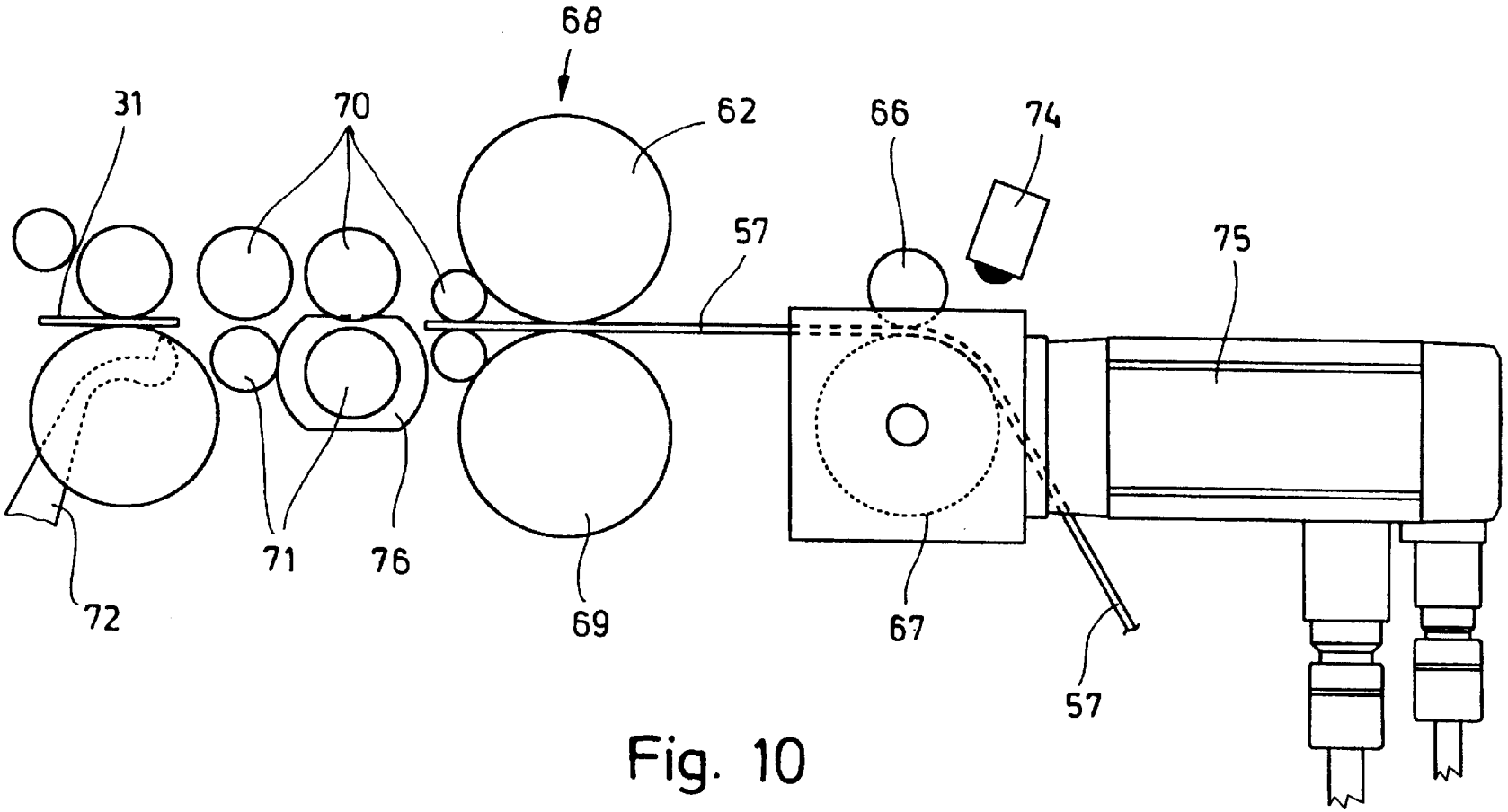

Further details of the invention are explained in greater detail below with the aid of embodiments, given by way of example. The diagrams show:

FIG. 1 an example of a one-piece blank for the production of hinge-lid packets, in a spread-out position, FIG. 2 a hinge-lid packet produced from a blank according to FIG. 1, in perspective view and with an open lid, FIG. 3 a detail of the hinge-lid packet according to FIG. 2, on a greatly enlarged scale, FIG. 4 a one-piece blank for a hinge-lid packet of a different form of embodiment, FIG. 5 a hinge-lid packet with a collar made of a separate blank, in perspective view and with an open lid, FIG. 6 a collar for a hinge-lid packet according to FIG. 5, likewise in perspective view, FIG. 7 details of the manufacture of collars according to FIG. 6, in outline, FIG. 8 a cutter wheel or a developed view of a casing surface of same for the manufacture of (individual) blanks for collars, FIG. 9 a collar produced with a cutter wheel according to FIG. 8, FIG. 10 a device for manufacturing collars according to FIG. 9, in simplified side view.

The embodiments shown in the drawings relate to hinge-lid packets for cigarettes, cigarillos or other consumer goods. Packets of this kind consist of thin cardboard.

The basic structure is clear in particular from FIG. 2 and FIG. 5. According to these diagrams, the hinge-lid packet consists of a (lower) packet portion 10 and a lid 11. The packet portion 10 of the overall cuboid package consists of a packet front wall 12, a facing packet rear wall 13, narrow upright packet side walls 14 and 15 as well as a base 16. In analogous fashion, the lid 11 consists of lid front wall 17, lid rear wall 18 as well as lid side walls 19, 20 and an upper end wall 21. The packet side walls, 14, 15 and likewise the lid side walls 19, 20 are, in this form of embodiment of a hinge-lid packet, configured double-layered, consist namely in each case of packet side flaps 22, 23 and lid side flaps 24, 25. These side flaps extend approximately over the whole width of the side walls 14, 15 or 19, 20 and cover one another. The side flaps 22 . . . 25 are connected together by gluing to form the side walls.

Packet portion 10 and lid 11 are connected to one another via a line joint 26 in the region of lid rear wall 18 on the one hand and packet rear wall 13 on the other hand. The lid 11 can be moved between opened position (FIG. 2, FIG. 5) and closed position (not shown) through the line joint.

In the closed position, the lid front wall 17 adjoins an upper front closing edge 27 of the packet portion 10. The front closing edge 27 is the upper transverse delimitation of the packet front wall 12. In the region of the packet side walls 14, 15 there are formed sloping side closing edges 28, 29. Adjacent to these lie the correspondingly (trapezoid) designed lid side walls 19, 20 in the closed position.

A collar 30, 31 forms part of the hinge-lid packet. This collar consists of a collar front wall 32 and collar side flaps 33, 34. The collar 30, 31 has a special geometric shape, namely with an open recess 35 in the region of the collar front wall 32.

The collar 30, 31 is fixed inside the packet portion 10. The lower region of the collar 30, 31 here dips down into the packet portion 10. The collar front wall 32 is adjacent to the inner side of the packet front wall 12. The collar side flaps 33, 34 are adjacent to the inner side of the packet side walls 14, 15. These surfaces of the collar 30, 31 form fastening surfaces with which the collar 30, 31 is fastened to the inner side of the packet portion by gluing. The surfaces of the collar 30, 31 protruding out of the packet portion 10 form visible surfaces on the outside.

In an advantageous embodiment of a hinge-lid packet according to FIG. 1 and FIG. 4, a one-piece blank is provided for the hinge-lid packet. The collar 32 is connected as one piece with a main blank 36 for packet portion 10 and lid 11. The unity of the (total) blank is effected in the present case by webs 37 which act as vestigial connections. Outside these webs 37, the collar 30 is separated from the main blank 36 by punched-out lines 38, 39. The punched-out lines 38, 39 simultaneously define the front closing edge 27 and the side closing edges 28, 29. The webs 37 are limited at the side by severance cuts 60, 61. The webs 37 are accordingly connected with the collar 30 on the one hand and the packet front wall 12 on the other hand via transverse hinges which guarantee a Z-shaped fold.

Where the hinge-lid packet is produced from a blank according to FIG. 1, the collar 30 is displaced relative to the main blank 36, folding the webs 37 in a Z-shape. According to FIG. 2 and FIG. 3, these webs are adjacent to the inner side of the packet front wall 12 maintaining the connection with the collar 30. Outside the webs, the collar 30 is, in usual fashion, adjacent on the inside to the collar front wall 12 and can be connected to same by gluing. Equally, lower regions of the collar side flaps 33, 34 are adjacent to the inner side of the packet side walls 14, 15 (FIG. 2).

An important special characteristic consists in the fact that the collar 30 is provided on its outer side with printing, namely with a printed colour layer 40. This is indicated by dots in the drawings. These surface areas of the collar 30, 31 are referred to below as visible surfaces 41. These visible surfaces 41, essentially the external surface regions of the collar 30, 31 protruding out of the packet portion 10, can be completely covered with a printed colour layer 40, or also simply provided with decorative printing or with details about the contents, such as advertising details and other information etc. It is also possible to apply (in addition) a legally required warning.

In the region of the visible surfaces 41, the printed colour layer 40 is covered by an outer protective layer 42. This layer consists of a coat of lacquer or varnish of known composition. The protective layer 42 is generally glossy or highly glossy and protects the printed colour layer 40.

A special characteristic of the present hinge-lid packets consists in the division of the front surfaces of the collar 30, 31. The surfaces of the collar 30, 31 lying inside the packet portion 10, i.e. covered, do not have any printing on them, are correspondingly free of printed colour layers 40 and also free of protective layers 42. The collar's fastening surfaces, to be described in detail, are configured in traditional fashion in the region of the upper surfaces. These fastening surfaces are fastened by glue to the associated surfaces of the hinge-lid packet.

On the embodiment according to FIG. 1, a strip-shaped fastening surface 43, 44 is formed in the region of the collar front wall 32 and the collar side flaps 33, 34, adjacent to the packet front wall 12 and to the (outer) packet side flaps 22. A rectangular strip-shaped fastening surface 43 is formed in the region of the collar front wall 32, including the webs 37. In the region of the collar side flaps 33, 34, the fastening surface 44 is configured as a parallelogram to correspond with the contour of the collar 30 in this region. The width of the fastening surfaces 43, 44 corresponds approximately to the depth to which the collar 30 is inserted in the packet portion 10. As is clear from FIG. 2, the printed visible surface 41 is of such dimensions that it is slightly overlapped by the packet front wall 12 or the packet side walls 14, 15.

A blank for a hinge-lid packet according to FIG. 2 can be produced economically in regard to the configuration of the visible surfaces 41 and fastening surfaces 43, 44. In its flat state, the surfaces of the main blank 36 are printed in the usual manner. At the same time, or in the course of this operation, the visible surfaces 41 of the collar 30 are also printed and provided with the protective layer 42, delimiting the free fastening surfaces 43, 44. On the present embodiment areas of the main blank 36 are also free of printing and protective layer, namely side flaps 23 lying on the inside of the packet and side flaps 24 lying on the inside of the lid and a corner flap 45 lying in the region of the end wall 21 on the finished hinge-lid packet.

A special characteristic consists in the fact that the fastening surfaces 43, 44 on the side facing the main blank 36 have an edge strip 46. This strip is formed in the region of the collar 30 as a continuation of possible printing of the packet front wall 12 and/or of the packet side walls 14, 15 or of the outer packet-side flaps 22, that is with printing and, if necessary, a protective layer which corresponds to the portion of the hinge-lid packet. The edge strip 46 forms a tolerance region for technically determined inaccuracies in the application of the punched-out lines 38, 39. The idea is to ensure that, in each case, the packet front wall 12 and the packet side walls 14, 15 are continuously printed exactly up to the front closing edge 27 and to the side closing edges 28, 29.

FIG. 4 shows a blank for a hinge-lid packet which corresponds largely to that according to FIGS. 1 to 3. In the region of the collar 30, an additional blank is connected as one piece to the collar 30, namely a coupon 47. The latter consists of the same material as the blank 30. The coupon is connected with the collar 30 via easily detachable vestigial connections 48, in the region of the recess 35 of the collar front wall 32. The coupon 47 is configured in this region as a tongue 49 which protrudes into the recess 35, fitting same. A foldable limb 50 adjoins the tongue 49. On the finished hinge-lid packet, the limb 50 extends in the plane of the end wall 21 or parallel to same on the inner side of the end wall 21.

When this hinge-lid packet is used, the coupon 47 can be easily detached from it. The hinge-lid then has the traditional or described shape in the region of the collar. The coupon 47 can be provided with printing, inscriptions, information or advertising details.

FIG. 5 shows a hinge-lid packet of traditional design in the opened position and in which the collar is formed from a separate blank (FIG. 6, FIG. 7). In respect of the printing of the collar 31, the procedure with this example, given by way of example, is analogous to the examples described.

The collar is, as is especially clear from FIG. 6, provided in a lower region both of the collar front wall 32 and of the collar side flaps 33, 34 with fastening surfaces 51, 52,. These are configured in the described manner, i.e. free of printing (colour layers) and protective layer or lacquer. The untreated fastening surfaces 51, 52 are represented by hatching. In the region of the collar front wall 32, the fastening surface 51 extends approximately over half the height of the collar front wall 32. Above a separating line 53, a visible surface 54 is formed which has printing on it, i.e. a printed colour layer 40, and an outer protective layer 42 or a coat of varnish. In the region of the collar side flaps 33, 34 there is formed a sloping separating line 55 between the lower fastening surface 52 and the upper trapezoid visible surface 56.

Inside the hinge-lid packet or packet portion 10 (FIG. 5), the collar 31 is fastened with fastening surfaces 51, 52 to the packet front wall 12 and the packet side walls 14, 15 by gluing. The relative position of the collar 31 is chosen to be such that the visible surfaces 54, 56 extend into an upper edge region of the packet portion 10, i.e. to slightly below the front closing edge 27 and the side closing edges 28, 29.

A collar 31 configured in the sense of FIG. 6 can be produced by means of process technology in such a way that the blanks designed with a known, usual contour are separated in succession from a material web 57. The material web 57 consists of thin cardboard. Before the individual collars 31 are detached, the outer surfaces of the collars 31 are prepared. In the region of the continuous material web 57, printing, in the form of printed colour layers 40, is applied to the collar front wall 32 and collar side flaps 33. In addition, the external protective layer 42 or lacquer is applied in these regions. The hatched regions, i.e. fastening surfaces 51, 52 remain free of printed colour and protective layers. In order to position the separating lines 53 and 55 exactly, the material web 57 is controlled by print marks 58 in the region of a printing unit (not shown).

As is clear from FIG. 7, the blanks of the collars 31 are detached with an edge strip 59 forming a lower free edge. The latter is provided with a continuation of the printing of the following collar 31, including the outer protective layer. The edge strip 59 serves as a tolerance region for applying a punched-out line by means of which the blanks for the collar 31 are separated. This guarantees that an upper edge of the collar 31 always has the printing, at least that there is no unprinted edge.

A device for the manufacture of individual blanks for collars 31 is of special importance. FIG. 8 shows as the most important part of the device a cutting cylinder 62 or a section of a casing surface of same. The cutting cylinder 62 is provided along its circumference with blades 63 disposed at equal distances from one another. These are cutters which are shaped in the contour of the collars 31 and protrude above the casing surface of the cutting cylinder 62.

The blades 63 are arranged on the cutting cylinder 62 at (peripheral) distances 64 from one another which are slightly greater than the corresponding lengths 65 of the collars 31. For example, the distance 64 between the blades 63 is 52.9 mm, whilst the corresponding length 65 of the collar 31 is 52 mm. The reason for this lies in the fact that the cutting cylinder 62 is driven at a slightly greater peripheral speed than the conveying speed of the material web 57. The difference in speed can be approximately 2%. In order to even this out, the greater distance between blades 63 is provided to produce collars 31 of an exact size. The cutting cylinder 62 is fitted—according to its diameter—with seven or eight blades 63 along its circumference.

The cutting cylinder 62 is a component of a device such as is shown in an advantageous form of embodiment in FIG. 10. The material web 57, preferably drawn from a reel (not shown) is conveyed by preliminary rollers 66, 67 at an exact speed. After the preliminary rollers 66, 67, the material web 57 reaches the region of a cutting assembly 68. The latter consists of the cutting cylinder 62 described and a counter-roller 69 running with it.

The blanks of the collars 31 separated in the region of the cutting assembly 68 are grasped by connecting conveyors, namely conveying rollers 70, 71 and carried onward at a higher speed. In this way, the separated collar gains (greater) distance from the material web 57. A further conveying member, namely a carrier lever 72, passes the collar 31 on to a preferably transverse conveyor (not shown) which leads the collar 31 onward for further processing. This region can advantageously be configured in accordance with EP 0 324 160.

The operating mode of the device, especially of the cutting assembly 68, is controlled by the printed marks 58 on the material web 57 in order exactly to position punched-out lines transversely to the material web 57 so that the collars 31 may be detached (FIG. 7). In the present example, a printed marks reader 74 of known construction is attached above the movement path of the material web 57, here in a region where said web is deflected by the preliminary rollers 66, 67. This reader controls the movement of the material web 57 in such a way that the punched-out line 73 is inserted at the exact position. To this end, the preliminary rollers 66, 67 are driven by a servomotor 75 which is connected for control purposes with a central control unit of the packaging machine.

The manufacture of the blanks for the collar 31 in the region of the cutting assembly 68 is matched to the rhythm of the packaging machine. For this purpose, there is arranged in the region of one of the conveying rollers 70, 71 a member which recognizes the respective position of a collar 31 after separation. This is a so-called resolver 76, i.e. a member which recognizes the position of the blank with the aid of respective angle positions. For control purposes, the resolver 76 cooperates with the printed marks reader 74. Altogether, the control members 74 and 76 lead to the (exact) production of the blanks being matched to the rhythm of the machine. Any deviations are compensated for via the servomotor 75 with the aid of the preliminary rollers 66, 67.

What is claimed is:

1. Hinge-lid packet made of cardboard, comprising a packet portion (10) and a lid (11) which is connected by a hinge in a region of a lid rear wall (18) via a line joint (26)

to a packet rear wall (13), and a collar (30, 31) being arranged in the packet portion (10) and attached with lower fastening surfaces (43, 44; 51, 52) in a region of a collar front wall (32) and collar side flaps (33, 34) to an inner side of a packet front wall (12) and by packet side walls (14, 15), and of which a region protruding from the packet portion (10) forms free visible surfaces (41, 54), characterized by the following features:

a) the free visible surfaces (41, 54) end in a region of an upper front closing edge (27) formed by the packet front wall (12) and in a region of upper side closing edges (28, 29) formed by the packet side walls (14, 15) and border there the fastening surfaces (43, 44; 51, 52);

b) of the free visible surfaces (41, 54) of the collar front wall (32) and collar side flaps (33. 34) which protrude from the packet portion (10), at least one of said free visible surfaces is provided with a printed color layer (40);

c) the printed color layer (40) is covered by a protective layer (42); and d) the printed color layer (40) covered by the protective layer (42) extends over a region of the said at least one of said free visible surfaces in such a way that the fastening surfaces (43, 44; 51, 52) of the collar front wall (32) and collar side flaps (33, 34) are free of any of the printed color layer (40) and protective layer (42).

2. Hinge-lid packet according to claim 1, characterized in that the collar (31) is formed from a separate blank and exhibits the free visible surfaces (54) approximately in a region of an upper half of the collar front wall (32) and the collar side flaps (33, 34), said free visible surfaces (54) being provided with the printed color layer (40) and the protective layer (42), while lower regions of the collar front wall (32) and of the collar side flaps (33, 34), being fastening surfaces (51, 52), are free of the printed color layer (40) and protective layer (42).

3. Hinge-lid packet according to claim 1, characterized in that a collar blank for the collar (30) is connected as a single piece to a main blank (36) for the packet portion (10) and the lid (11) forming a one-piece overall blank, specifically by means of one or more Z-shaped foldable connecting webs (37) between the packet front wall (12) and the collar front wall (32), the collar (30) forming in a free end region of the collar blank a visible surface which has the printed color layer (40) with protective layer (42) and, adjacent to the packet portion (10), a strip-shaped fastening surface (43, 44) which, when the collar (30) is placed in the packet, is adjacent to the inner side of the packet front wall (12) and the packet side walls (14, 15) after the webs (37) have been folded in a Z-shape.

4. Hinge-lid packet according to claim 1, characterized in that formed in a lower edge region of the collar (30, 31) is a narrow edge strip (46, 59), which also has the printed color layer (40) and protective layer (42).

5. Hinge-lid packet according to claim 1, characterized in that the fastening surfaces (43, 44; 51, 52) on the one hand, and the free visible surfaces (41, 54) on the other hand, follow in their contours, or with respect to a course of separating lines (53, 55) between the fastening surfaces (43, 44; 51, 52) and the free visible surfaces (41, 54), the contour of front closing edge (27) and side closing edge (28, 29) between the packet portion (10) and lid (11).

6. Hinge-lid packet according to claim 1, characterized in that in a region of the collar (30, 31), a coupon (47) is connected as one piece to the collar (30, 31) by means of residual connections (48), it being the case that the coupon (47) is also provided with the printed color layer and the protective layer and can be detached when the hinge-lid packet is used for the first time.

7. A device for manufacturing separate blanks for forming collars (31) of cigarette packets of the hinge-lid type, blanks for the collars (31) being capable of being detached in succession via transverse stamped-out lines (73) from a continuous material web (57) which is made of thin cardboard and which has, on regions thereof corresponding to free visible surfaces of each collar which protrude from the packet, a printed color layer (40) covered by a protective layer (42), wherein:

a) the material web (57) is conveyed downstream through a cutting assembly (68) for detaching the collars (31) during continuous conveying of the material web (57) in a conveying direction, b) upstream of the cutting assembly (68) there are arranged preliminary rollers (66, 67) for controlling forward movement of the material web (57) in the conveying direction, c) a printed marks reader (74) is arranged above or below the material web (57) to detect printed marks (58) disposed on a web side facing the printed marks reader (74), d) the cutting assembly (68) is controlled by the printed marks reader (74), in respect of the exact application of the stamped-out lines (73), to detach the blanks from the web (57), and e) conveying members including conveying rollers (70, 71) carry away the collars (31) as they are detached from the material web (57) in the region of the cutting assembly (68) to create a distance from the material web (57).

8. The device according to claim 7, further comprising a monitoring unit to determine exactly the position of a collar, especially a resolver (76) attached to the conveying rollers to control production of the collars (31) in coordination with the rhythm of a packaging machine.

9. A method of manufacturing blanks for collars (31) as part of a hinge-lid packet, comprising the steps of:

a) applying a printed color layer (40) and a protective layer (42) covering the printed color layer (40) on a continuous material web (57) of thin cardboard, said material web comprising the blanks used for forming the collars (31), such that the printed color layer (40) and the protective layer (42) are applied to the material web (57) in a partial region of each of the blanks such that the partial regions of each of the blanks are spaced apart from one other in the longitudinal direction of the material web (57), with the printed color layer (40) and protective layer (42) being delimited by separating lines (53, 55) from free fastening surfaces (51, 52) lying on a same side of the material web (57); and b) severing the blanks from the continuous material web (57) of thin cardboard.

10. The method according to claim 9, where, in the severing step b, the blanks used for forming the collars (31) are severed from the material web (57) by punched-out lines (73), such that the punched-out lines (73) are not made exactly at a transition from a fastening surface (51, 52) to an area having the printed color layer (40), but rather in a region of the printed color layer (40) near said transition and under a formation of a printed edge strip (59), which after punching, lies on an edge of the fastening surface (51, 52) opposite the printed color layer (40).

11. The method according to claim 9, wherein the material web (57) is provided with printed marks (58) in a correct position for use in printing and punch-cutting processes for manufacturing the blanks for the collars (31).

* * * * *